United States Patent [19]

Norman

[11] 4,274,760

[45] Jun. 23, 1981

[54] SELF-PROPELLED UNDERWATER TRENCHING APPARATUS AND METHOD

[76] Inventor: Robert M. Norman, P.O. Drawer 53475, Lafayette, La. 70501

[21] Appl. No.: 8,849

[22] Filed: Feb. 2, 1979

Related U.S. Application Data

[63] Continuation of Ser. No. 829,350, Aug. 31, 1977, abandoned.

[51] Int. Cl.[3] ..... E02F 5/02; E02F 5/14

[52] U.S. Cl. ..... 405/163; 405/160; 405/162

[58] Field of Search ..... 405/163, 162, 161, 164, 405/165, 154, 156; 37/54, 58, 65, 86, 87, 64

[56] References Cited

U.S. PATENT DOCUMENTS

| | | | |
|---|---|---|---|
| 3,004,392 | 10/1961 | Symmank | 405/163 |
| 3,368,358 | 2/1968 | Elliott | 405/163 |
| 3,717,003 | 2/1973 | Bates et al. | 405/162 |
| 3,732,701 | 5/1973 | Lynch | 405/162 |
| 3,751,927 | 8/1973 | Perot | 405/163 |
| 3,877,237 | 4/1975 | Norman | 405/163 X |
| 3,995,439 | 12/1976 | Hahlbrock | 405/161 |
| 4,037,422 | 7/1977 | de Boer et al. | 405/163 X |

*Primary Examiner*—Dennis L. Taylor

*Attorney, Agent, or Firm*—Francis A. Keegan

[57] ABSTRACT

This invention relates to the self-propelled underwater trenching apparatus and method for burying pipelines, cables and the like with minimum underwater diver supervision. The apparatus includes a frame having frame members positioned about the pipeline. Drive rollers are connected to the frame members for drive engagement with the pipeline. The frame members are movable about a pivot to selectively engage into or disengage rollers out of drive engagement with the pipeline. The apparatus also may include extensible means to move the pivot axis laterally or transversely of the pipeline. The formation is cut away by water jets secured to the apparatus to enable the pipeline to be buried in the trench formed. Upon meeting an obstruction on the surface of the pipeline, power rams in the fore portion of the frame member separate the frame member that may bend the frame member to bring the forward drive rollers out of driving engagement with the pipeline. The hydraulic propulsion system directs fluid flow to the aft drive rollers in driving engagement with the pipeline to move the apparatus forwardly until the forward drive rollers have overridden the obstruction. The sequence is reversed to utilize the forward drive rollers to move the apparatus along the pipeline until the aft drive rollers have overridden the pipeline.

68 Claims, 5 Drawing Figures

202
210
216
214
212
212
204
186
186
186
28
204
184
4
3
84
140
3
142
190
30
26
38
66
30
38
24
76
142
70
32
24
24
136
132
42
50
48
92
48
32
136
156
130
46
92
130
200
44
162
164
34
86
166
22
78
22
82
86
36
162
144
154
170
168
152
172
182
150
172
182
174
178
170
188
196
172
170
20
194
180
170
4

SELF-PROPELLED UNDERWATER TRENCHING APPARATUS AND METHOD

This is a continuation of application Ser. No. 829,350, filed Aug. 31, 1977, now abandoned.

BACKGROUND OF THE INVENTION

This invention relates generally to a self-propelled underwater trenching apparatus. More particularly the present invention is concerned with the self-propelled underwater buoyant apparatus for burying pipelines or cables and the like to lay on the floor of a body of water. Uniquely, the present invention further relates to apparatus for burying pipelines or cables which may have an uneven surface that may present an obstruction to the continuous movement of the apparatus along the pipeline and cable.

DESCRIPTION OF PRIOR ART

In U.S. Pat. Nos. 3,926,003, 3,877,237, divisions of co-pending application Ser. No. 175,448 filed Aug. 27, 1971, in the name of the present inventor, there is disclosed an apparatus for burying pipelines, cables and the like in the bottom formation of a body of water. The apparatus therein disclosed utilizes high pressure fluid in the form of water jets positioned in advance of the movement of the apparatus along the pipeline to cut away a trench in the bottom formation into which the pipeline will rest. This prior art apparatus was designed to be supported by the pipeline to be buried and propelled along the pipeline by a propulsion system utilizing resiliently urged drive rollers. The drive rollers were held on a frame structure positioned on each side of the pipeline. In order to reduce the weight of the trenching apparatus on the pipeline, buoyancy tanks were provided to provide a buoyant effect that was an aid in minimizing the possible damage to any coating on the pipeline due to the weight of the apparatus and the rotating of the drive rollers. The formation was cut by a plurality of water jets positioned in the fore portion of the apparatus on each side of the pipeline and spraying cutting water jets in selected directions. Eductors were positioned aft of the jet means to suck up the cuttings and other debris that have formed in the trench by the jets. Other eductor tubes are disclosed in U.S. Pat. No. 3,368,358.

This prior apparatus was designed to be supported above and below the pipeline by means of elongated idler rollers which held the apparatus to the pipeline and were adjustable for various diameters of pipeline. This apparatus, although successful commercially in the past, is no longer in use because it possessed inherent limitations in its operation and more importantly required diver supervision to overcome various pipeline conditions.

The requirement of the presence of a diver is not only a substantial additional expense to the overall operation but slows dramatically the progress of burying of the pipeline during the work being performed by the diver to free the apparatus from any obstruction on the pipeline. Typical of these obstructions on the pipeline are the various cathodic protection devices secured to the pipeline surface to prevent corrosion of the pipeline.

Prior art trenching apparatus would not effectively and efficiently pass over such obstructions in the surface of the pipeline either because the drive rollers were unable to override the obstruction or that guiding rollers spaced in accordance with the pipeline diameter would be unable to override the cathodic protectors and still be effective to guide the apparatus along the pipeline. In instances of such obstruction, the diver must release one or more of the rollers or shift the position of the apparatus and then guide the apparatus along the pipeline until the obstruction is passed.

The requirement of diver participation in every instance when the apparatus would meet a cathodic device or other obstruction in the pipeline surface is clearly an undesirable characteristic; however, there are other drawbacks to trenching apparatus that are unable to override such obstructions. It has been found, for instance, that prior art trenching apparatus when contacting the pipeline obstruction without being capable of passing over the obstruction, permit the propulsion system to continue to urge the drive rollers in an effort to move the apparatus forwardly. Continued failure to produce such forward movement by the rotating drive rollers consequently wears away the usual corrosion resisting coating on the pipeline to expose the pipeline to the prospect of undue corrosion and the ultimate possibility of failure.

This possibility of damaging the pipeline requires constant attention by the crew manning the on-surface barge which directs the movement of the trenching apparatus. Any failure to maintain such attention produces not only undue delays in the progress of burying the pipeline but also, and more importantly, the possibility of serious damage to the pipeline.

OBJECTS OF THE INVENTION

It is the principal object of the present invention to provide a self-propelled underwater trenching apparatus for burying pipelines, cables, and the like, which minimizes the requirement of the presence of the underwater supervision of the diver to enable effective and efficient operation of the trenching apparatus to be substantially completely controlled on the water surface.

It is also an object of the present invention to provide underwater self-propelled trenching apparatus capable of overriding obstructions in the pipeline surface without requiring the presence of a diver or without causing damage to the pipeline and its coating.

This invention also has as an object the provision of underwater self-propelled trenching apparatus that selectively and alternately engages and disengages drive rollers to enable the trenching apparatus to override an obstruction in the pipeline surface.

Another object of the present invention is to provide a self-propelled underwater trenching apparatus in which the fore and aft portions of the apparatus open and close selectively and alternately to engage and disengage the drive rollers from driving engagement with the pipeline in the event that an obstruction in the pipeline surface is encountered.

Another object of the present invention is to provide a self-propelled underwater trenching apparatus for burying pipelines in which the frame of the apparatus may be temporarily bent into a more open position in order to permit drive rollers on the apparatus to override any obstruction in the pipeline surface.

A further object of the present invention is to provide for the opening and lateral extension of the frame in order to accommodate various sizes of pipeline.

A further object of the present invention is to provide a self-propelled underwater trenching apparatus capable of detecting power flow changes to drive rollers in driving engagement with the pipeline and proportioning the power flow to maintain the motivation of selected rollers having a greater resistance to moving the apparatus along the pipeline in order to override obstructions in the pipeline surface.

Yet another object of the present invention is the provision of methods for underwater trenching for the burying of pipeline in which the variations in power flow to drive rollers is detected and controlled to alternately and selectively direct power to drive rollers that are selectively and alternately in drive engagement with the pipeline.

Still another object of the present invention is the provision of a method for underwater trenching by selectively and alternately engaging and disengaging drive rollers to permit an override of an obstruction in the pipeline surface.

These and other objects of the present invention shall become more apparent upon careful study of the following detailed description and the appended claims including the following drawings:

THE DRAWINGS

SUMMARY OF THE INVENTION

Figure 1:
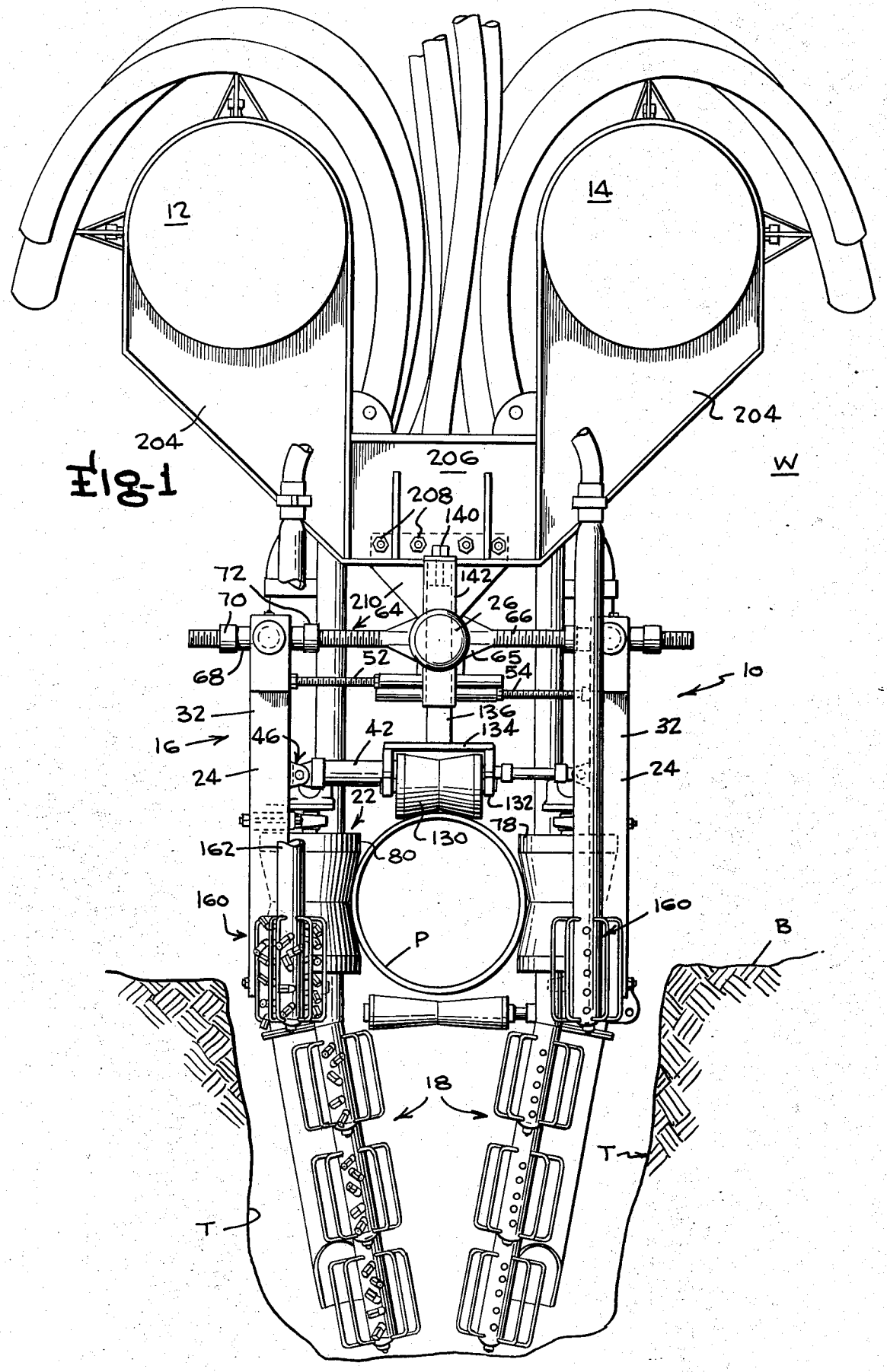
FIG. 1 is a front elevational view in section and partly broken away illustrating the positioning of the underwater trenching apparatus along the pipeline and the positioning of the cutting jet means.

The self-propelled underwater trenching apparatus and method of this invention burys pipelines, cables and the like with formation cutting water jets. The frame of the apparatus includes frame members positioned about the pipeline fore and aft. Drive rollers are connected to each frame member for selective drive engagement with the pipeline. The fore and aft portions of the frame members are movable by rams about a pivot to selectively engage into or disengage rollers out of drive engagement with the pipeline. The apparatus also may include telescopic extensible means to move the horizontal axis laterally or transversely of the pipeline. An obstruction on the surface of the pipeline is overridden by power rams between the fore portion of the frame members that separate the frame members, and may bend the frame members, to bring the forward drive rollers out of drive engagement with the pipeline. The hydraulic propulsion system motivating the driver rollers selectively directs fluid flow to the aft driver rollers in driving engagement with the pipeline to move the apparatus forwardly until the forward drive rollers have overridden the obstruction and then the ram returns the frame to its original position and the forward drive rollers again into drive engagement with the pipeline. The sequence is then reversed to utilize the forward drive rollers to move the apparatus along the pipeline until the aft drive rollers have overridden the pipeline.

DESCRIPTION OF THE INVENTION

General Description

FIGS. 1 through 4 of the drawing disclose generally the buoyant underwater self-propelled trenching apparatus 10 constituting the present invention. The apparatus is guided along pipeline P to be buried in the trench T formed by the trenching apparatus in the bottom B of a body of water W. The apparatus proceeds in the direction of the arrow shown in FIG. 2 while burying the pipeline. As the trench is dug out of the bottom formation the pipeline falls into the trench and is back-filled by the cutting debris and water currents to bury the pipeline. A barge or ship (not shown) is on the surface above the trenching apparatus to supply power and fluids required by the apparatus and to provide various other control and recording procedures.

Figure 2:
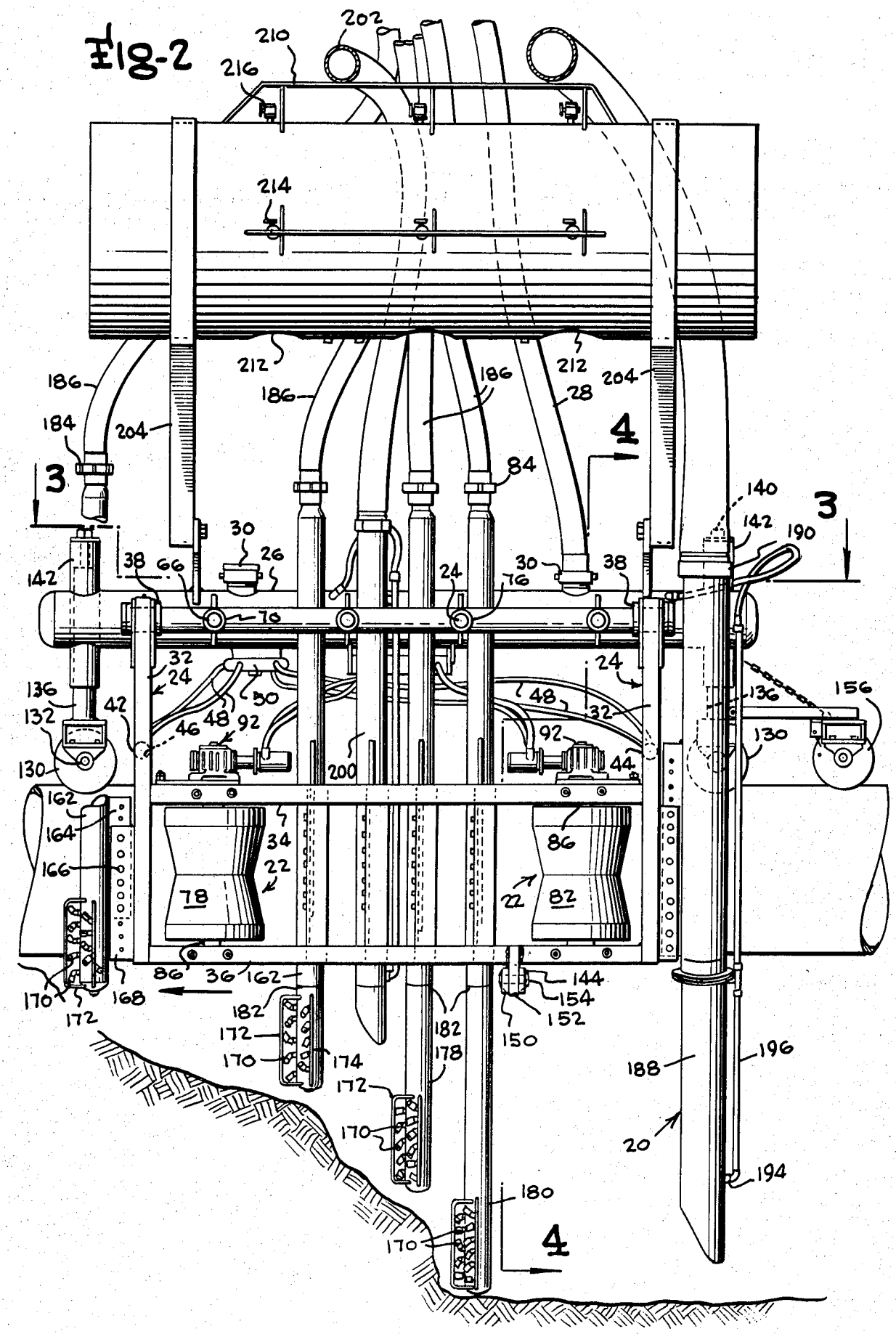
FIG. 2 is a side elevational view partly broken away illustrating the positioning of the buoyancy tanks, drive rollers, the cutting jets for forming the trench in the bottom formation and the airlift means for removing the formation cuttings.

The buoyant underwater self-propelled trenching apparatus of the present invention is composed of several elements. The buoyancy of the apparatus is controlled by the buoyancy tanks 12 and 14 positioned on each side of the apparatus 10. A frame 16 generally depicts a portion of the apparatus astride or surrounding the pipeline P. Supported on the frame are a plurality of the formation cutting jet means 18 positioned to achieve the most efficient and effective cutting of the formation. Airlift means 20 are secured to the frame and draw up the cuttings from the jets 18 and discharge them away from the apparatus. Drive roller means 22 is secured to the frame and is in driving engagement with the pipeline for propelling the apparatus forwardly along the pipeline. The drive rollers are best shown in FIG. 2.

The Frame Structure

The trenching apparatus 10 is composed basically of a frame 16 composed of frame members 24 positioned on each side of the pipeline. The structural rigidity of the frame is enhanced by connection with manifold 26 which is supplied with air pressure by suitable pipes 28 connected to the manifold by connections 30. The pipes 28 are connected to the surface vessel from which they receive the supply. The manifold 26 may be any suitable size and shape but it is preferred to be in the form of an elongated steel cylinder closed at the ends.

Positioned on each side of the pipeline are the frame members 24 formed from elongated tubular upright beam members 32 extending vertically upwardly at the forward and aft ends of the apparatus. Connected between these upright beam members 32 are upper and lower bars 34 and 36 suitably connected to the upright beam members 32 to form support for the drive roller means 22. At the upper end of each beam member 32 is a bearing 38. Journaled within the bearing 38 to permit pivotal movement of the frame members 24, are tubular pivot shafts 40 extending the length of the apparatus on each side of the pipeline. The frame members 24 including the upper and lower bars 34 and 36 to which the drive roller means 22 are attached are able to pivot about each pivot shaft 40.

Connected between the vertical beam members for pivotal movement of the frame members 24 are double acting rams 42 and 44 having a pinned rod and yoke connection to the upright beam members 32 as shown at 46. This connection 46 permits some angular movement between the beam members 32 and the end of the rod in the connection 46. Ram 42 is positioned in the forward end of the apparatus and transversely contacts the fore portion of each of the frame members 24 while ram 44 is positioned at the aft end of the apparatus and operates independently on the aft portions of each frame member 24.

The rams 42 and 44 may be suitably powered in any manner but preferably are operated hydraulically through suitable hydraulic hose connections 48 extending from each end of rams 42 and 44 and connected to ram actuator 50 which operates to actuate selectively ram 42 or 44 to open or close the frame members 24. Suitable control mechanism extending to the surface enables the crew on the barge to open or to close independently foreward ram 42 or aft ram 44.

To limit the movement of the frame members inwardly upon a closing force being applied by either forward ram 42 or aft ram 44 are extensible abutments 52 and 54 extending between the upright beam members 32 in the fore portion of the frame and also positioned to extend between the aft portion of the rear member. The abutments are held stationary by being connected to web 56 that may be welded to the underside of the manifold 26. The abutments 52 and 54 are easily extensible by reason of the screw threads, as shown, to permit the trenching apparatus to accommodate large pipeline diameters. These abutments may contract into their respective housings 58 and 60 which are connected to the web 56. When abutments are extended to a preselected distance to accommodate a pipeline of known pipe diameter, the abutments strike the inside surfaces of the upright beam members 32 at 62 to limit any further inward movement of the upright member 32 and therefore frame member 24 should there be further action of the fore or aft rams 42 and 44.

Figure 3:
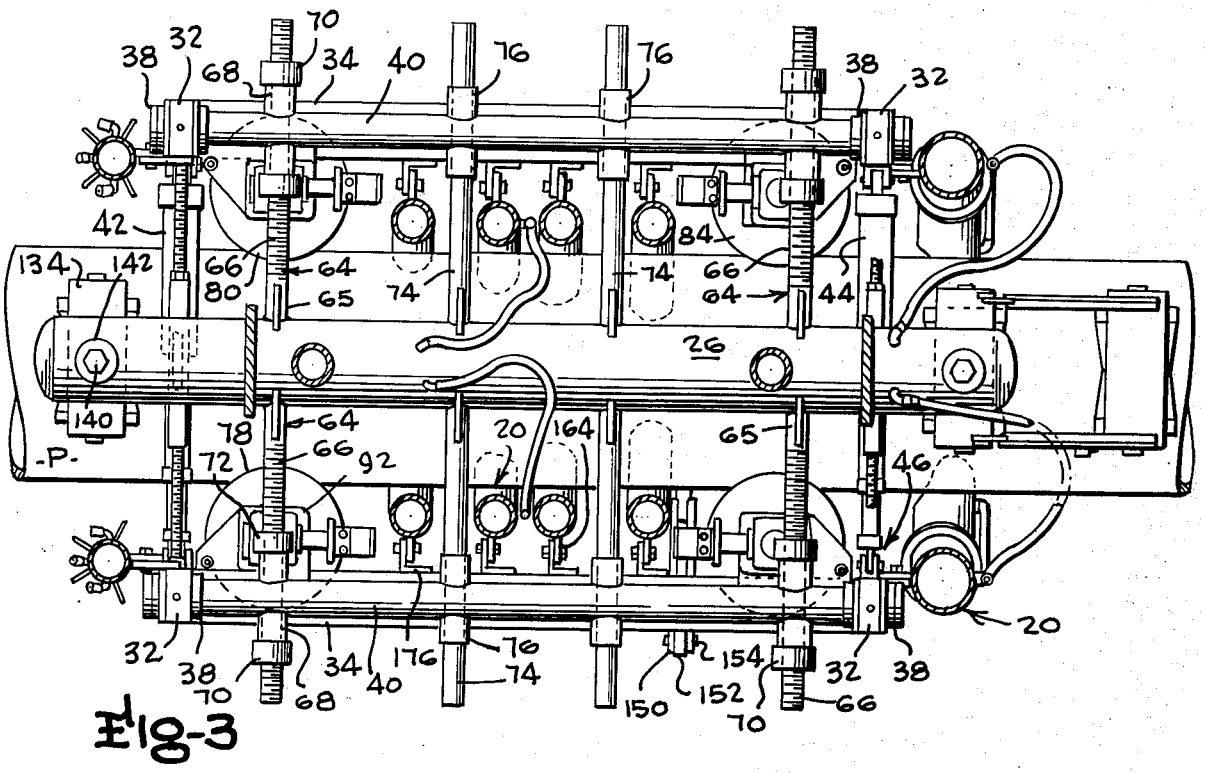
FIG. 3 is a cross-sectional view taken along lines 3—3 of FIG. 2.
Figure 4:
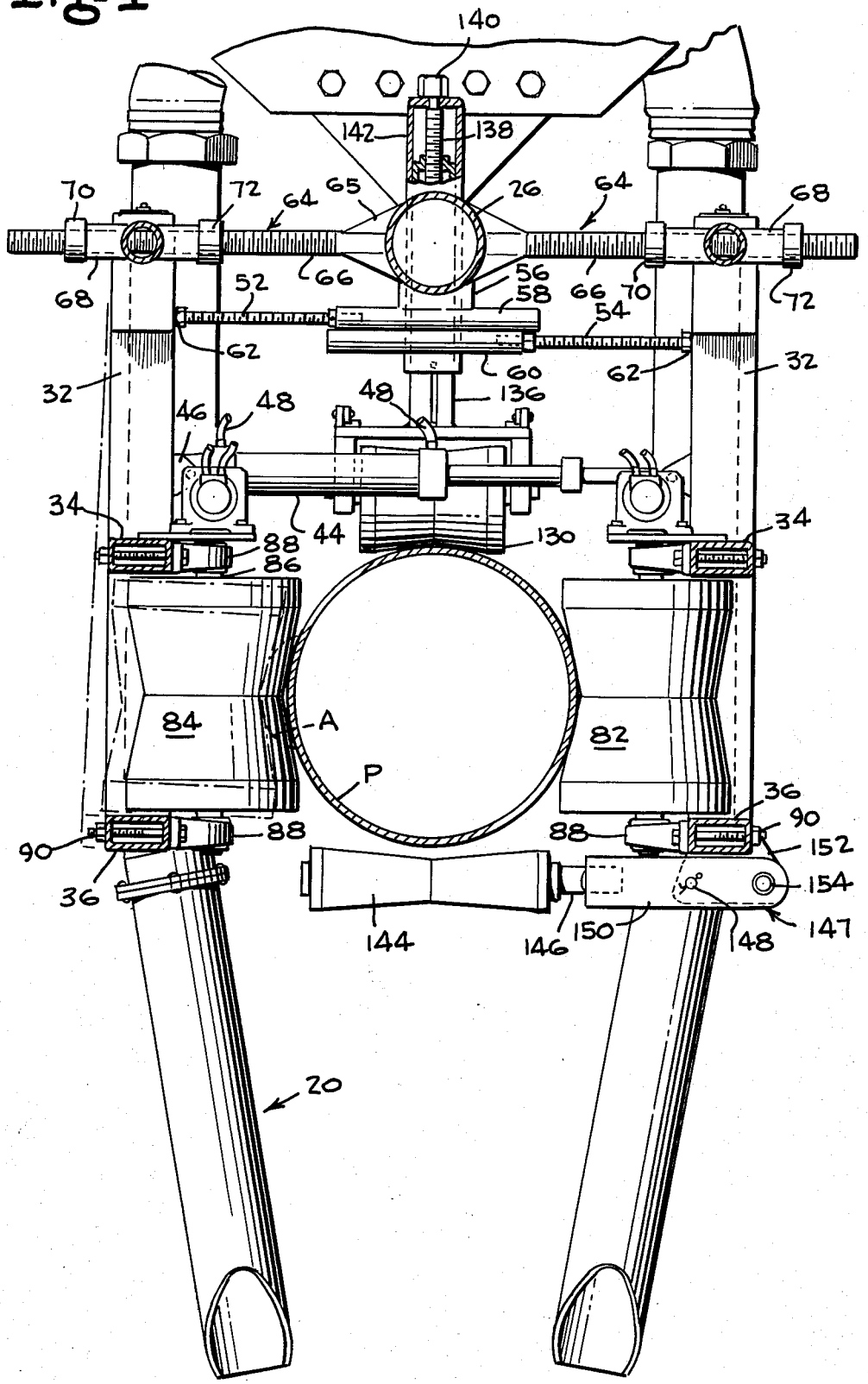
FIG. 4 is a cross-sectional view partly broken away taken along lines 4—4 of FIG. 2 to illustrate particularly the telescopic means, the abutment means, and the means for pivoting frame members.

In addition to the pivotal movement of the frame member 24, frame members are laterally extensible by telescopic means 64 extending on each side of the pipeline to contact the pivot shaft in both the fore and aft portions of the apparatus, as best shown in FIG. 4. Each telescopic extensible means 64 is secured at one end 65 to the side of the manifold 26 and includes a threaded rod 66 received into elongated sleeve 68 extending on both sides of the pivot shaft 40. Threaded nuts 70 and 72 on each side of each sleeve 68 hold the telescopic extensible threaded rod 66 in any pre-selected position limited only by the diameter of the pipeline and the length of threaded rod 66. Companion telescopic extensible support rods 74 as shown in FIG. 3, may be positioned longitudinally between the threaded telescopic extensible threaded rods 66 and are secured in the same manner to the manifold as by welding at 65. The rods 74 are passed through the pivot shaft 40 and are slidable in non-threaded sleeves 76 extending from the pivot shaft to support the sliding movement of rod 74 on each side of and through the pivot shaft 40.

It should be apparent that by coordinated operation of nuts 70 and 72 and the absence of pressure applied to rams 42 and 44, that the frame members 24 and the pivot shafts 40, which provide the horizontal axis for the pivoting of the frame members 24, may be moved transversely or laterally toward or away from the pipeline P. The adjustments and extensions of the frame are useful to accommodate various diameters of pipeline.

Rollers and Propulsion

The roller means 22 include pairs of forwardly positioned rollers 78 and 80 and aft rollers 82 and 84. One roller of each pair is positioned in the opposing frame member 24, as is best shown in FIGS. 2, 3 and 4. The rollers each have axes 86 extending above and below the upper and lower surfaces respectively of the roller and are journaled for rotation in bearings 88 which are bolted to upper and lower bars 34 and 36 by securing means 90 such as the nut and bolt arrangement shown. The roller means 22 are secured between the upper and lower bars 34 and 36 for rotation within the journal 88 and have no other movement independent of the frame member 24.

Figure 5:
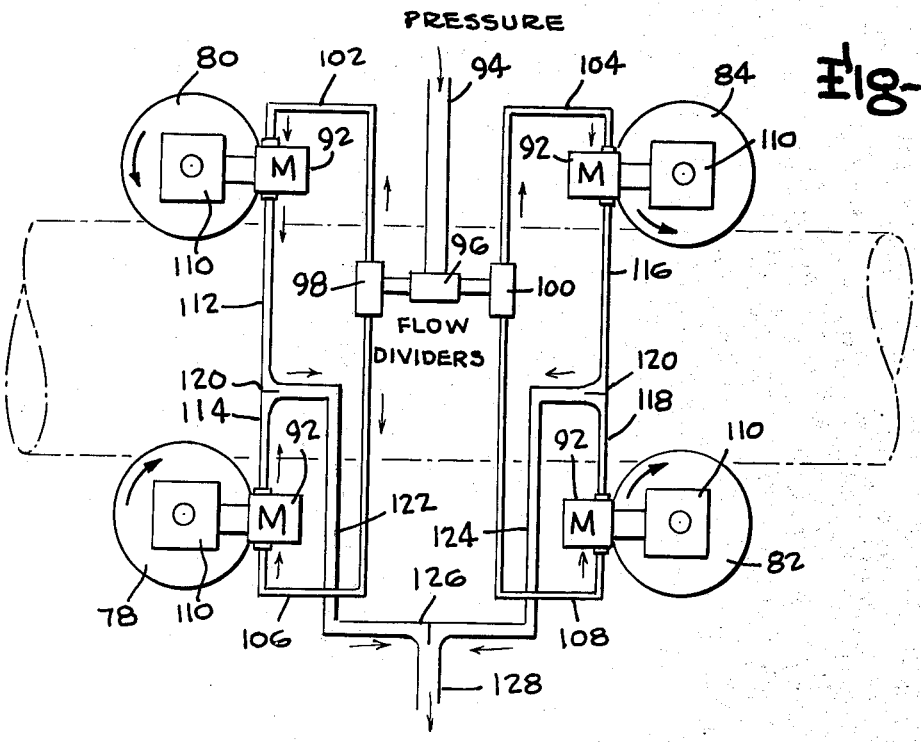
FIG. 5 is a schematic illustration of the power fluid flow to the drive wheels.

Each roller in the roller means is rotated by a fluid actuated motor 92 of conventional design. As best shown in the schematic drawing of FIG. 5, the fluid motors 92, 92, 92, 92 operate drive rollers 78, 80, 82 and 84 in a unique manner to assure the movement of the pipeline. The hydraulic or other fluid from a source on the barge is admitted to hose 94 under pressure and directed into primary flow divider 96. Secondary flow dividers 98 and 100 direct the fluid for the forward and aft drive rollers respectively through appropriate hoses 102 and 104 and 106 and 108. Each of these hoses directs fluid into the power side of the motors connected to their drive rollers to rotate the drive rollers through conventional gear boxes 110. Return fluid is extracted by hoses 112, 114, 116 and 118 through suitable valve arrangements 120 and out collector hoses 122 and 124 through valve 126 to return hose 128. Collector hoses may be half inch diameter while feed hoses 102 through 108 may be quarter inch diameter. Supply hose 94 and return hose 128 may then be three-quarter inch diameter. The sizes of the hoses are optional and may vary substantially in accordance with the apparatus design.

The flow dividers operate to direct greater or lesser fluid flow into the respective feed hoses in accordance with the feed hose back pressure sensed by the flow dividers. In the event of greater back pressure being sensed, for instance, in feed hose 102 and 106 for forward rollers 78 and 80, sufficient fluid flow is delivered through flow dividers 96 and 98 into these same feed hoses 102 and 106 to meet the greater power needs of these rollers and maintain the speed of rotation of the rollers. Similarly should aft drive rollers 84 and 82 be slipping and rotating freely or should they be disengaged from driving contact with the pipeline, such as when an obstruction in the pipeline is to be overridden, a drop in pressure will be experienced in feed hoses 104 and 108 that would be sensed in the flow divider 96. Fluid pressure automatically is then reduced in the direction of these drive rollers 82 and 84 having ineffective drive engagement with the pipeline. At the same time sufficient fluid flow would be directed to drive rollers 78 and 80 assuming they maintain driving engagement with the pipeline. Such driving engagement would be sensed by the flow dividers 98 and 96 from the back pressure in hoses 102 and 106.

It should be clear that should either of the forward position drive rollers 78 and 80 or the aft positioned drive rollers 82 and 80 begin to slip or be in disengaged or otherwise experience inoperative driving engagement, flow divider 98, for the forwardly positioned drive rollers 78 and 80, and flow divider 100, for the aft position drive rollers 82 and 84, would accordingly direct sufficient fluid pressure to that drive roller exhibiting the greatest back pressure and maintain the most effective drive roller engagement to move the apparatus.

Alternatively, each motor 92 may be powered by a positive displacement pump which constantly directs the same amount of fluid to each motor irrespective of one or more motors experiencing more or less resistance to rotation. Thus should the selected motors be disengaged they would rotate at the same speed as engaged motors. The purpose of this modification construction is to be able to select the speed of rotation for the drive rollers and thus control the speed of the apparatus down the pipeline.

The forward drive rollers 78, 80 are preferably positioned between the formation jet cutting means 18 as best shown in FIG. 2 and more particularly, aft of the forward jet cutting means. The positioning of the drive roller in such a manner enables the drive roller to follow the pipeline unimpeded along the clear shallow trench formed by the forward jet cutting means and guide the apparatus along any pipeline curvature. Aft positioned jets cut the formation deeply to form the trench precisely along the path of the pipeline.

In addition to the drive roller means 22, a top roller 130 is secured to the apparatus and depends from the manifold 26. This top roller 130 is journaled along a horizontal axis at 132 into a yoke 134 secured to a vertical shaft 136, as best shown in FIGS. 1 and 4. The shaft 136 is adjustable vertically by telescopic threaded rod 138. This rod is received into the upper end of the hollow shaft 136 producing sliding movement of the shaft 136 by operation of nut 140 to screw the shaft vertically within the housing 142. The shaped design of top roller 130 enables it to act as an idler roller to rest on top of the pipeline P and to center the pipeline to achieve the most effective drive engagement with the drive rollers 78, 80, 82 and 84.

A bottom roller 144 extends along the horizontal axis and is also an idler roller freely rotating on shaft 146 when in contact with the bottom of the pipeline and the underwater trenching apparatus is moving along the pipeline. The bottom roller is designed to prevent the apparatus from being dislodged from the pipeline by upward movement of the apparatus. However, with sufficient upward movement that might otherwise damage the apparatus if it were rigidly held in position on the pipeline, a breakaway fastening means 147 is provided in the form of a shear pin 148 holding the yoke 150 to the plate 152 secured to the frame member 24. Pivot shaft 154 passes through the yoke 150 and plate 152. The shear pin 148 holds the bifurcated yoke 150 to the plate 152 to hold the bottom roller 144 in horizontal position. Should the apparatus then be forced upwardly with sufficient force, the shear pin 148 will fail and bottom roller 144 will swing downwardly about pivot 154 thus releasing the trenching apparatus from the pipeline.

The present apparatus also is provided with an additional roller in the form of counter roller 156 as best shown in FIG. 2. This counter roller rests at all times on the top of the pipeline to record the footage of the pipeline being buried. Suitable signals and recording devices are transmitted to the surface barge to enable the crew to determine the progress of the apparatus burying the pipeline and also to detect instantaneously any stoppage of the burying.

Cutting Jet Means and Air Lifts

The cutting jets 18 are preferably positioned in pairs similarly situated along the opposed frame members 24. As best shown in FIG. 2 the cutting jets are positioned to extend in stepwise fashion more deeply into the trench and, other than the forward jets, are angled inwardly toward the aft end of the apparatus. The forward jets are higher, vertical and spaced apart a greater distance. The cutting jets in the leading position in the fore part of the apparatus are shown at 160 and are formed from high pressure tubing into a cutting head 162. This cutting head is provided with a multi-holed bolting frame or fishback 164 secured by suitable bolts 166 to complementary frame fishback 168 welded to upright 32. If desirable, additional cutting heads could be added to the apparatus and be within the scope of the invention. Each cutting head is provided with a plurality of jet nozzles 170. Each of these jet nozzles is selected to be directed at an angle and may range from 5° to 270° relative to the vertical axis of the cutting head. Horizontal disposition of the angle of the jet nozzle varies usually within a full half circle or greater.

The nozzles 170 secured to the high-pressure tubing 162 are preferably protected by a plurality of U-shaped guards 172 which protect the nozzles from contact with the formation or dislodged debris. The guards are formed from single rods bent into a U-shaped form and welded to the tubing. Preferably, and as shown in FIG. 1, the nozzles are positioned on the tubing 162 in a plurality of vertical rows, preferably three. In the manner described in my previous patents, the rearward thrust of these jet nozzles may be offset by tilting, turning, or reversing the position of the jet nozzle.

The forward cutting jets being positioned higher and being spaced wider apart are effective to form an initially wide but shallow trench which clears a path for the forward drive rollers to guide the apparatus to move along the pipeline and shift the apparatus should a pipeline curvature be encountered. The following cutting heads positioned aft of the forward cutting head and aft of the forward drive rollers 78, 80 are effective to produce a trench of the desired depth. These cutting heads will have been guided and shifted by the forward drive rollers 78, 80 to cut the formation directly beneath the pipeline.

Cutting heads 174 are each secured in a fashion similar to that described for the cutting head 160 except that the corresponding tubing is rigidly secured to the upper and lower bars 34 and 36 as best shown in FIGS. 2 and 3. The only significant difference is that the fishback, being secured to the upper and lower bars 34 and 36, is essentially L-shaped as shown in 176 in FIG. 3. As can best be seen from FIG. 2, cutting head 174 extends slightly below cutting head 160 and behind drive rollers 78, 80 so that all the jet nozzles on cutting head 174 are exposed and effective to cut the formation. Similarly, cutting head 178 and 180, again each being secured to the frame member 24, extend further downwardly into the trench in the manner describing the relationship between cutting head 174 and 160. As best shown in FIG. 1, the high-pressure tubing 162 is angled at 182 in order to have the cutting heads directed downwardly and inwardly at a angle up to 30° from the vertical. Each of the cutting tubes is secured at 184 to individual water hoses 186 which extend to the surface barge where suitable pump apparatus applies high pressure water to be discharged through individual nozzles.

The airlift means 20 is secured to each frame member 28 in a manner similar to that described for the cutting tubes. The tubing used for the airlift means positioned in the aft end may be of larger diameter as shown at 188. Secured to the upper end of airlift tubing 188 by coupling 190 is large diameter flexible hose 192 which extends well above the apparatus and is free to discharge the cuttings and debris. To operate the airlift means, high pressure air is supplied through nozzle at 198. Air rising in the tubing 188 causes a suction to lift the cuttings. The air is supplied to the air nozzle 194 through air pipe 196 to which is secured a flexible hose 198 connected to air supply in the manifold 26. Preferably the lower end of the airlift tubing 188 is angled inwardly to approximate the inward angle of the cutting tubes as best shown in FIGS. 1 and 4.

Forwardly positioned airlift 200 may be the same size as the airlift tubing 188 or smaller and is secured to the upper and lower bars 34 and 36 in the same manner as the aft airlift tubing. Discharge by the airlift means 200 is through discharge tubing 202. It should be pointed out that the air pressure supplied through nozzle 194 is not critical as any air pressure supplied would rise in the airlift tubing and create the suction necessary. Higher air pressure, of course, produces greater suction effect.

Buoyancy

The buoyancy important to control the pressure of the apparatus upon the pipeline particularly, a pipeline having a corrosion coating is achieved through buoyancy tanks 12 and 14. Each of these tanks is secured to the apparatus by cradle struts 204 partially surrounding the buoyancy tanks and extending downwardly to support carriage 206. This carriage is suitably bolted at 208 to web 210 welded to the manifold 26. The buoyancy tanks 12 and 14 are so supported in the fore and aft locations to enable the buoyancy created by the buoyancy tanks to be effective in reducing the apparent weight of the underwater trenching apparatus.

The buoyancy tanks may be of any design and construction and preferably have water inlets at the bottom shown at 212 and air inlets at the top as shown at 214. The air inlets 214 may be connected to the manifold 26 to supply the air necessary to control the buoyancy of the tanks. Suitable protective bars 216 are provided to safeguard air inlets against damage.

As is known in the art, the tanks will readily fill with water upon submersion of the apparatus and upon opening of the air outlet valves 216. When the tanks are filled with water there would be no buoyant effect. But as the water is pumped out of the tanks the buoyant effect is evident with the maximum buoyancy obviously being achieved when all the water has been discharged.

Operation

The present underwater trenching apparatus is designed to create a trench T by cutting the formation from the bottom B of the body of water. The apparatus is self-propelled by the drive rollers 78, 80, 82 and 84 which grip the pipeline in driving engagement. In the event that there is an obstruction on the pipeline such as an anode A, as best shown in FIG. 4, the apparatus of this invention is able to override the obstruction even with the lack of any resilient mounting of the drive rollers on the apparatus.

Detection of the obstruction would be apparent from the signal received from the counter roller 156 that the apparatus has stopped and the fact that drive rollers would be spinning while in contact with the pipeline creating a wearing effect on the corrosion coating placed on the pipeline. Without the necessity of a diver in attendance to supervise the apparatus, the fore portions of the frame member 24 may be opened perhaps only a few inches by activating ram 42. Upon activation of the ram the fore portion of the frame member 24 pivots slightly in bearing 38 but also bends the upper and lower bars 34 and 36 slightly to create at this time greater separation or spacing between the fore portions of the frame members. Aft ram 44 maintains the aft portion of frame member 24 in contact with the aft abutment 52 and 54. The greater separation of the fore portions of the frame members also separates forward drive rollers 78 and 80 from driving engagement upon pipeline P. Pressure in feed hoses 102 and 106 is reduced, but fluid power is maintained to aft motors 92. In this case flow divider 96 directs sufficient fluid pressure to aft drive rollers 82 and 84 which alone are then capable of moving the underwater apparatus along the pipeline for a distance sufficient to enable forward disengaged drive rollers 78 and 80 to override the obstruction A. Upon passing the obstruction A in the pipeline surface, ram 42 is activated to close the fore portion of the frame member 24 to bring drive rollers 78 and 80 into full driving engagement.

Upon further movement of the apparatus along the pipeline rear drive rollers 82 and 84 can be expected to contact the same obstruction and the entire process repeated to open the aft portion of the frame member with ram 44 to disengage the aft drive rollers 82 and 84. Sufficient fluid pressure is maintained to forward drive rollers 78 and 80 to move the apparatus along the pipeline and permit aft disengaged drive rollers 82 and 84 to override the obstruction A. Upon the obstruction A being overriden by the disengaged aft drive rollers, ram 44 is activated to draw the aft portion of the frame together to contact the abutments 52 and 54 and bring the aft drive rollers in full drive engagement with the pipeline.

We claim:

1. An underwater trenching apparatus for burying pipeline and the like comprising:

a frame for positioning about the pipeline to be buried, said frame including frame members positioned on each side of said pipeline, roller means connected to at least one of said frame members for engagement with said pipeline, pivot means positioned on said frame for pivoting each said frame member about a substantially horizontal axis parallel to the pipeline transversely toward and away from roller engagement with said pipeline, means operative upon said frame for laterally moving said pivot means and said horizontal axis to shift said frame members transversely to the axis of the pipeline, and cutting means secured to said apparatus for cutting a trench in a formation whereby said pipeline is buried.

2. The underwater trenching apparatus of claim 1 including, said pivot means including power means connected to said frame member and extending transversely to said pipeline for selectively and independently moving the fore and aft portions of each said frame member toward and away from roller engagement with said pipeline.

3. The underwater trenching apparatus of claim 1 including, said pivot means including power means being connected separately to the fore portion and to the aft portion of said frame member and extending transversely to said pipeline.

4. The underwater trenching apparatus of claim 1 including, said pivot means including power means connected to the fore and aft portions of each said frame member and extending transversely to said pipeline for bending the frame member upon selective moving of one portion of said frame member relative to said pipeline without moving the remaining portions of the same frame member.

5. The underwater trenching apparatus of claim 1 including, said pivot means including a plurality of power rams for selective movement of the fore and aft portions of each said frame member toward and away from roller engagement.

6. The underwater trenching apparatus of claim 5 including said power rams being connected separately to the fore and aft portion of each said frame member and extending transversely to said pipeline for selectively bending said frame member relative to said pipeline without moving the remaining portion of the same frame member.

7. The underwater trenching apparatus of claim 1 including, said roller means including at least one drive roller in contact with said pipeline in each of a fore portion of a frame member and in an aft portion of a frame member.

8. The underwater trenching apparatus of claim 7 including, said pivot means including power means connected to the fore and aft portions of each said frame member and extending transversely to said pipeline for bending the frame member upon selective moving of one portion of said frame member relative to said pipeline without moving the remaining portion of the same frame member.

9. The underwater trenching apparatus of claim 8 including, said power means being connected separately to the fore and aft portion of each said frame member and extending transversely to said pipeline for selectively bending said frame member relative to said pipeline without moving the remaining portion of the same frame member.

10. The underwater trenching apparatus of claim 7 including, said pivot means including power means connected to the fore and aft portions of each said frame member and extending transversely to said pipeline for bending the frame member upon selective moving of one portion of said frame member relative to said pipeline without moving the remaining portions of the same frame members.

11. The underwater trenching apparatus of claim 7 including, drive means for each said drive roller, control means to alternately drive a selected roller in contact with said pipeline with sufficient force to move said apparatus along said pipeline.

12. The underwater trenching apparatus of claim 2 including, said roller means including at least one drive roller in drive contact with said pipeline in each of a fore portion of a frame member and in an aft portion of a frame member, drive means for each said drive roller, control means to drive said roller remaining in driving engagement with said pipeline with sufficient force to move the apparatus along the pipeline.

13. The underwater trenching apparatus of claim 4 including, said roller means including at least one drive roller in driving contact with said pipeline in each of a fore portion of a frame member and in an aft portion of a frame member, drive means for each said drive roller, control means to drive said roller remaining in driving engagement with said pipeline with sufficient force to move the apparatus along the pipeline and prior to the bending of the frame member corresponding to the portion of the frame member having said disengaging other drive roller thereon.

14. An underwater trenching apparatus for burying pipeline and the like having a pipeline surface obstruction comprising:

a frame for positioning about the pipeline to be buried, said frame including frame members positioned on each side of said pipeline, drive rollers connected to at least a fore portion of one of said frame members and to an aft portion of one of said frame members for drive engagement with said pipeline, first disengaging means to selectively alternately disengage at least one of said drive rollers from driving engagement with said pipeline in one portion of said frame member, drive means continuing to drive a drive roller in another portion of said frame member with sufficient force to move said apparatus along said pipeline a sufficient distance whereby said disengaged roller overrides said obstruction on the surface of said pipeline, second disengaging means to selectively and alternately disengage said previously engaged drive roller from said pipeline while said drive means drives said previously disengaged drive roller with sufficient force to move said apparatus along said pipeline, over said obstruction, and cutting means secured to said apparatus for cutting a trench in a formation whereby said pipeline is buried.

15. The underwater trenching apparatus of claim 14 including, pivot means positioned on said apparatus for pivoting each said frame member about a substantially horizontal axis toward and away from roller engagement with said pipeline.

16. The underwater trenching apparatus of claim 15 including, each frame member having a both fore and aft drive roller, and said disengaging means being a ram connected to the fore and to the aft portions of at least one frame member.

17. The underwater trenching apparatus of claim 14 including said frame member being relatively rigid but capable of being bent by said disengaging means whereby to selectively and alternately disengage a drive roller.

18. The underwater trenching apparatus of claim 17 including, each frame member having both a fore and an aft drive roller.

19. The underwater trenching apparatus of claim 14 including, said disengaging means being a ram connected to the fore and to the aft portions of at least one frame member.

20. The underwater trenching apparatus of claim 1 including, said roller means being driven by fluid motor means, said fluid motor means including flow divider control means to proportion fluid flow to maintain motivation of selected rollers of said roller means having the greater resistance to moving said apparatus along the pipeline.

21. The underwater trenching apparatus of claim 1, including, said roller means including at least one drive roller in contact with said pipeline in each of a fore portion of a frame member and in an aft portion of a frame member said roller means being driven by fluid motor means, said fluid motor means including flow divider control means to proportion fluid flow to maintain motivation of selected rollers of said roller means having the greater resistance to moving said apparatus along the pipeline.

22. The underwater trenching apparatus of claim 1 including, said roller means including at least one drive roller in contact with said pipeline in each of a fore portion of a frame member and in an aft portion of a frame member, drive means for each said drive roller, control means to alternately drive a selected roller in contact with said pipeline with sufficient force to move said apparatus along said pipeline, and said control means including flow divider control means to proportion fluid flow to maintain motivation of selected rollers of said roller means having the greater resistance to moving said apparatus along the pipeline.

23. The underwater trenching apparatus of claim 1, including, said pivot means including power means connected to said frame member for selectively and independently moving the fore and aft portions of each said frame member toward and away from roller engagement with said pipeline, said roller means including at least one drive roller in contact with said pipeline in each of a fore portion of a frame member and in an aft portion of a frame member, drive means for each said drive roller, driving engagement with said pipeline with sufficient force to move the apparatus along the pipeline, and said control means including flow divider control means to proportion fluid flow to maintain motivation of selected rollers of said roller means having the greater resistance to moving said apparatus along the pipeline.

24. The underwater trenching apparatus of claim 14, including, said drive means including fluid motor means, said fluid motor means including flow divider control means to proportion fluid flow to maintain motivation of selected rollers of said drive rollers having the greater resistance to moving said apparatus along the pipeline.

25. The underwater trenching apparatus of claim 14, including, at least one drive roller being in selective contact with said pipeline in each of a fore portion of a frame member and in an aft portion of a frame member, and said drive means including fluid motor means, said fluid motor means including flow divider control means to proportion fluid flow to maintain motivation of selected rollers of said drive rollers having the greater resistance to moving said apparatus along the pipeline.

26. The underwater trenching apparatus of claim 14, including, said frame member being relatively rigid but capable of being bent by said disengaging means to selectively and alternately disengage a drive roller, at least one driver roller being in selective contact with said pipeline in each of a fore portion of a frame member and in an aft portion of a frame member, and said drive fluid motor means, said fluid motor means including flow divider control means to proportion fluid flow to maintain motivation of selected rollers of said drive rollers having the greater resistance to moving said apparatus along the pipeline.

27. The underwater trenching apparatus of claim 14 including, said frame member being relatively rigid but capable of being bent by said disengaging means whereby to selectively and alternately disengage a drive roller, at least one drive roller being in selective contact with said pipeline in each of a fore portion of a frame member and in an aft portion of a frame member, said drive means including fluid motor means, said fluid motor means including flow divider control means to proportion fluid flow to maintain motivation of selected rollers of said drive rollers having the greater resistance to moving said apparatus along the pipeline, and each frame member having both fore and aft drive rollers.

28. The underwater trenching apparatus of claim 14 including, said frame member being relatively rigid but capable of being bent by said disengaging means whereby to selectively and alternately disengage a drive roller, at least one drive roller in selective contact with said pipeline in each of a fore portion of a frame member and in an aft portion of a frame member, said drive means including fluid motor means, said fluid motor means including flow divider control means to proportion fluid flow to maintain motivation of selected rollers of said drive rollers having the greater resistance to moving said apparatus along the pipeline, each frame member having a bore fore and aft drive roller, and said disengaging means being a ram connected to the fore and to the aft portions of at least one frame member.

29. In an underwater trenching apparatus for burying pipeline and the like having a frame for positioning about the pipeline to be buried, drive rollers positioned fore and aft on said frame for moving the apparatus along the pipeline, drive means for driving said drive rollers and cutting means secured to said apparatus for cutting a formation for burying said pipeline, the improvement for enabling the apparatus to override obstructions in the pipeline surface comprising:

control means for said drive means to vary the power directed to said drive rollers, said control means including power flow detection means operatively associated with each fore and aft drive rollers, power flow divider means operatively connected to said power detection means to proportion the power flow to drive selected rollers having the greater resistance to moving said apparatus along the pipeline whereby to enable the apparatus to override the obstruction on the pipeline surface.

30. The underwater trenching apparatus of claim 29 including, disengaging means to selectively alternately disengage at least one of said drive rollers from driving engagement with said pipeline in one portion of said frame member.

31. The underwater trenching apparatus of claim 30 including, second disengaging means to selectively and alternately disengage said previously engaged drive roller from disengagement with said pipeline while said drive means drives said previously disengaged drive roller with sufficient force to move said apparatus along said pipeline, over said obstruction.

32. The underwater trenching apparatus of claim 29 including, pivot means positioned on said apparatus for pivoting each said frame member about a substantially horizontal axis toward and away from roller engagement with said pipeline.

33. The underwater trenching apparatus of claim 32 including, said pivot means including power means connected to the fore and aft portions of each said frame member for bending the frame member upon selective moving of one portion of said frame member relative to said pipeline without moving the remaining portions of the same frame member.

34. The underwater trenching apparatus of claim 32, including, said pivot means including a plurality of power rams for selective movement of the fore and aft portions of each said frame member toward and away from roller engagement.

35. The underwater trenching apparatus of claim 34 including, said power rams being connected separately to the fore and aft portion of each said frame member for selectively bending said frame member relative to said pipeline without moving the remaining portion of the same frame member.

36. The underwater trenching apparatus of claim 1 including, said means for moving said pivot means being extensible telescopic means operatively connected to said frame members between said apparatus and said pivot means.

37. The underwater trenching apparatus of claim 1 including, said pivot means including power means connected to said frame member for selectively and independently moving the fore and aft portions of each said frame member toward and away from roller engagement with said pipeline, said means for moving said pivot means being extensible telescopic means operatively connected to said frame members between said apparatus and said pivot means, and said extensible telescopic means being connected to said frame members above said power means.

38. The underwater trenching apparatus of claim 1 including, each said frame member having a support bar for said roller means, upright beam means connected to said support bar having bearing means to permit pivoting of said frame member.

39. The underwater trenching apparatus of claim 1 including, each said frame member receiving a pivot shaft journaled at the ends to form said horizontal axis.

40. The underwater trenching apparatus of claim 39 including, extensible telescopic means to move the frame members transversely being connected to each pivot shaft means.

41. The underwater trenching apparatus of claim 40 including, said extensible telescopic means operatively connected to said frame members and extending from said apparatus to said pivot shaft for lateral movement of said pivot shaft and said horizontal axis.

42. The underwater trenching apparatus of claim 41 including, said extensible telescopic means being connected to said frame members above said power means.

43. The underwater trenching apparatus of claim 38 including, each said frame member receiving a pivot shaft journaled at the ends to form said horizontal axis, extensible telescopic means to move the frame members transversely being connected to each pivot shaft means, said extensible telescopic means operatively connected to said frame members and extending from said apparatus to said pivot shaft for lateral movement of said pivot shaft and said horizontal axis, and said extensible telescopic means being connected to said frame members above said power means.

44. The underwater trenching apparatus of claim 1 including, each said frame member having support means for said roller means, said roller means including drive rollers positioned fore and aft on said frame member, upright members connected to said drive roller support means, said pivot means including a pivot shaft journaled within said upright members, said means for moving said pivot means being extensible telescopic means operatively connected to said frame members between said apparatus and said pivot means, and said pivot means including a plurality of power means operatively connected to said frame members below said means for moving said pivot means, whereby to achieve selective movement of the fore and aft portions of each frame member toward and away from roller engagement.

45. The underwater trenching apparatus of claim 44 including, said pivot means being selectively operable upon either or both the fore and aft portions of the frame member to move selectively one or more said portions to bend said frame member.

46. The underwater trenching apparatus of claim 45 including, each said frame member having a support bar for said drive roller means, and upright beam means connected to said support bar having bearing means to permit pivoting of said frame member.

47. The underwater trenching apparatus of claim 44 including, each said frame member having a support bar for said drive roller means, and upright beam means connected to said support bar having bearing means to permit pivoting of said frame member.

48. The underwater trenching apparatus of claim 44 including, said power means including first and second disengaging means to selectively and alternately disengage at least one of said drive rollers from said pipeline while another roller remains in contact with said pipeline and moves said apparatus along said pipeline.

49. The underwater trenching apparatus of claim 44 including said power means including disengaging means to selectively alternately disengage at least one of said drive rollers from driving engagement with said pipeline in one portion of said frame member.

50. The underwater trenching apparatus of claim 49 including, second disengaging means to selectively and alternately disengage said previously engaged drive roller from said pipeline while said drive means drives said previously disengaged drive roller with sufficient force to move said apparatus along said pipeline, over said obstruction.

51. The underwater trenching apparatus of claim 14 including, each said frame member having a support bar for said drive roller, and upright beam means connected to said support bar having bearing means to permit pivoting of said frame member.

52. The underwater trenching apparatus of claim 15 including, each said frame member having a support bar for said drive roller, and upright beam means connected to said support bar having bearing means to permit pivoting of said frame member.

53. In a method of underwater trenching of a bottom formation for burying a pipeline by jetting a trench with an apparatus having frame members supported on the pipeline and driven by fore and aft pipeline engaging drive rollers, the improvement comprising, contacting the pipeline with the drive rollers in driving engagement, selectively and disengaging a forwardly positioned drive roller from driving engagement with said pipeline, driving an aft positioned drive roller to enable said forward drive roller to move forwardly along said pipeline and override an obstruction on the pipeline surface, selectively disengaging said aft positioned drive roller from driving engagement with said pipeline, engaging said forward drive roller in drive engagement with said pipeline to move said aft drive roller above said pipeline and override said obstruction.

54. The method of claim 53 including, selectively and alternately opening and closing fore and aft portions of said frame members to selectively and alternately disengage driving engagement of a drive roller in a fore or aft position.

55. The method of claim 53 including applying a force selectively and alternately to a frame member to bend said frame member to selectively and alternately engage and disengage driving engagement of a drive roller in a fore or aft position.

56. A method of underwater trenching of a bottom with an apparatus having frame members supported on the pipeline and driven by fore and aft pipeline engaging drive rollers, the improvement comprising, detecting the amount of power directed to said drive rollers controling said drive rollers to vary power directed to said drive rollers, directing and dividing power to selected fore or aft drive rollers to maintain movement of said drive roller in driving engagement with said pipeline, whereby said apparatus moves along said pipeline to override obstructions on the pipeline surface.

57. The method of claim 56 comprising, driving an aft positioned drive roller to enable said forward drive roller to move downwardly along said pipeline and override an obstruction on the pipeline surface, selectively disengaging said aft positioned drive roller from driving engagement with said pipeline, engaging said forward drive roller in drive engagement with said pipeline to move said aft drive roller above said pipeline and override said obstruction.

58. The method of claim 56 comprising, selectively and alternately opening and closing fore and aft portions of said frame members to selectively and alternately disengage driving engagement of a drive roller in a fore or aft position.

59. The method of claim 56 comprising, applying a force selectively and alternately to a frame member to bend said frame member to selectively and alternately engage and disengaged driving engagement of a drive roller in a fore or aft position.

60. The method of claim 56 comprising, driving an aft positioned drive roller to enable said forward drive roller to move downwardly along said pipeline and override an obstruction on the pipeline surface, selectively disengaging said aft positioned drive roller from driving engagement with said pipeline, engaging said forward drive roller in drive engagement with said pipeline to move said aft drive roller above said pipeline and override said obstruction, selectively and alternately opening and closing fore and aft portions of said frame members to selectively and alternately disengage driving engagement of a drive roller in a fore or aft position.

61. The method of claim 56 comprising, driving an aft positioned drive roller to enable said forward drive roller to move downwardly along said pipeline and override an obstruction on the pipeline surface, selectively disengaging said aft positioned drive roller from driving engagement with said pipeline, engaging said forward drive roller in drive engagement with said pipeline to move said aft drive roller above said pipeline and override said obstruction, selectively and alternately opening and closing fore and aft portions of said frame members to selectively and alternately disengage driving engagement of a drive roller in a fore or aft position, applying a force selectively and alternately to a frame member to bend said frame member to selectively and alternately engage and disengage driving engagement of a drive roller in a fore or aft position.

62. The apparatus of claim 1 including, said roller means including guide means positioned intermediate said cutting means to guide said apparatus along said pipeline.

63. The apparatus of claim 62 including, said guide means being forwardly positioned drive rollers, said cutting means including forward cutting jets in front of said forwardly positioned drive rollers to clear a shallow trench in said formation, and rearward cutting jets extending below said forward jets and aft of said forward drive rollers, said rearward cutting jets extending downwardly below said pipeline to cut said trench for said pipeline to be buried.

64. The apparatus of claim 14 including, said drive rollers connected to said fore portion of said frame members being forwardly positioned and providing guide means intermediate said cutting means to guide said apparatus along said pipeline.

65. The apparatus of claim 64 including, said guide means being forwardly positioned drive rollers, said cutting means including forward cutting jets in front of said forwardly positioned drive rollers to clear a shallow trench in said formation, and rearward cutting jets extending below said forward jets and aft of said forward drive rollers, said rearward cutting jets extending downwardly below said pipeline to cut said trench for said pipeline to be buried.

66. The apparatus of claim 29 including, said drive rollers connected to said fore portion of said frame members being forewardly positioned and providing guide means intermediate said cutting means to guide said apparatus along said pipeline.

67. The apparatus of claim 66 including, said guide means being forwardly positioned drive rollers, said cutting means including forward cutting jets in front of said forwardly positioned drive rollers to clear a shallow trench in said formation, and rearward cutting jets extending below said forward jets and aft of said forward drive rollers, said rearward cutting jets extending downwardly below said pipeline to cut said trench for said pipeline to be buried.

68. The method of claim 53 including, providing forward cutting jets on said apparatus in front of said fore drive rollers and rearward jets aft of said fore drive rollers, cutting a shallow and wide trench with said forward cutting jets, guiding said apparatus along said pipeline with said fore drive rollers while cutting a deep and narrower trench with said rearward cutting jets.

* * * * *